US010322386B2

(12) United States Patent
Zheng et al.

(10) Patent No.: US 10,322,386 B2
(45) Date of Patent: Jun. 18, 2019

(54) GAS-LIQUID DISPERSION IMPELLER ASSEMBLY WITH ANNULAR-SECTOR-SHAPED CONCAVE BLADES

(71) Applicant: Jiangnan University, Wuxi, Jiangsu (CN)

(72) Inventors: Zhiyong Zheng, Jiangsu (CN); Dongdong Sun, Jiangsu (CN); Xiaobei Zhan, Jiangsu (CN); Minjie Gao, Jiangsu (CN)

(73) Assignee: Jiangnan University, Jiangsu (CN)

( * ) Notice: Subject to any disclaimer, the term of this patent is extended or adjusted under 35 U.S.C. 154(b) by 185 days.

(21) Appl. No.: 15/548,080

(22) PCT Filed: May 18, 2016

(86) PCT No.: PCT/CN2016/082483
§ 371 (c)(1),
(2) Date: Aug. 1, 2017

(87) PCT Pub. No.: WO2017/185431
PCT Pub. Date: Nov. 2, 2017

(65) Prior Publication Data

US 2018/0117544 A1 May 3, 2018

(30) Foreign Application Priority Data

Apr. 27, 2016 (CN) ..... 2016 1 0269169

(51) Int. Cl.
*B01F 3/04* (2006.01)
*B01F 7/00* (2006.01)
(Continued)

(52) U.S. Cl.
CPC ..... *B01F 7/0025* (2013.01); *B01F 3/04531* (2013.01); *B01F 7/00466* (2013.01);
(Continued)

(58) Field of Classification Search
CPC ..... B01F 3/04531; B01F 7/0025; B01F 7/00466; B01F 7/1675; B01F 7/20;
(Continued)

(56) References Cited

U.S. PATENT DOCUMENTS 4,779,990 A * 10/1988 Hjort ..... B01F 3/04531 261/93
5,198,156 A * 3/1993 Middleton ..... B01F 3/04531 261/87
(Continued)

FOREIGN PATENT DOCUMENTS

CN 2481403 Y 3/2002
CN 2813083 Y 9/2006
(Continued)

OTHER PUBLICATIONS

WIPO, Chinese International Search Authority, International Search Report dated Jan. 26, 2017 in International Patent Application No. PCT/CN2016/082483, 5 pages.

*Primary Examiner* — Charles S Bushey
(74) *Attorney, Agent, or Firm* — Masuvalley & Partners

(57) ABSTRACT

The invention discloses an agitation device comprising an impeller, an agitating shaft and a power device. The impeller includes a disc, a hub and concave blades. Each blade consists of a concave surface which extends radially and has an annular sector-like shape, the projections of the upper and lower portions of the blade in the horizontal plane are two annular sectors, and the radian of the annular sector obtained by the projection of the upper portion is larger than that of the lower portion, and the annular sector-like shape and the rotation direction of blades are the same, so that each portion of the blades directly faces an incoming flow, the utilization efficiency of blades is increased and the impeller has low energy consumption and high gas-liquid dispersion efficiency. The device is efficient and energy-saving, has low
(Continued)

power consumption, high mixing performance and high gas holdup and mass transfer performance.

26 Claims, 3 Drawing Sheets

(51) Int. Cl.
*B01F 7/26* (2006.01)
*B01F 7/16* (2006.01)
*B01F 7/20* (2006.01)
*B01F 15/00* (2006.01)

(52) U.S. Cl.
CPC ..... *B01F 7/1675* (2013.01); *B01F 7/20* (2013.01); *B01F 7/26* (2013.01); *B01F 15/00896* (2013.01); *B01F 2003/04673* (2013.01); *B01F 2215/0036* (2013.01)

(58) Field of Classification Search
CPC ..... B01F 7/26; B01F 15/00896; B01F 2003/04673; B01F 2215/0036
USPC ..... 261/91, 93
See application file for complete search history.

(56) References Cited

U.S. PATENT DOCUMENTS

| | | | | |
|---|---|---|---|---|
| 5,316,443 | A | 5/1994 | Smith | |
| 5,791,780 | A | 8/1998 | Bakker | |
| 5,904,423 | A * | 5/1999 | Forschner | B01F 3/04531 261/93 |
| 6,190,033 | B1 * | 2/2001 | Rickman | B01F 3/04531 366/265 |
| 8,277,114 | B2 * | 10/2012 | Higbee | B01F 3/04539 366/270 |

FOREIGN PATENT DOCUMENTS

| | | | |
|---|---|---|---|
| CN | 2902438 | Y | 5/2007 |
| CN | 101306333 | A | 11/2008 |
| CN | 101480587 | A | 7/2009 |
| JP | 5759625 | A | 4/1982 |

* cited by examiner

GAS-LIQUID DISPERSION IMPELLER ASSEMBLY WITH ANNULAR-SECTOR-SHAPED CONCAVE BLADES

RELATED APPLICATIONS

This application is the U.S. National Phase of and claims priority to International Patent Application No. PCT/CN2016/082483, International Filing Date May 18, 2016, entitled Gas-Liquid Dispersion Impeller Assembly With Annular-Sector-Shaped Concave Blades; which claims benefit of Chinese Application No. CN201610269169.6 filed Apr. 27, 2016; both of which are incorporated herein by reference in their entireties.

FIELD OF THE INVENTION

The present invention relates to the engineering equipment fields of biological engineering, chemical engineering, and environment engineering, and more particularly to a gas-liquid dispersion impeller assembly with annular sector-shaped concave blades.

DESCRIPTION OF THE RELATED ART

Gas-liquid two-phase mixing and mass transfer is widely applied in process units such as aerobic fermentation, oxidation reaction, hydrogenation reaction, and biological aeration. Chemical engineers expect to invent devices capable of implementing efficient gas-liquid dispersion. Currently, devices capable of implementing gas-liquid two-phase dispersion mainly include: (1) bubble column reactors; (2) airlift reactors; (3) agitating devices with gas-liquid dispersion impellers; (4) mixing systems assembly with rotary jet heads.

Radial flow impeller is a type of device particularly suitable for gas-liquid dispersion. It includes a hub, a disc and a plurality of blades uniformly distributed on the disc, where the disc can collect bubbles below the impeller and guide the bubbles into a high-shear blade area, thereby achieving good gas-liquid dispersion. In 1950's, Rushton firstly invented the flat-blade impeller that was called Rushton turbine usually, which achieved innovative application in the fields of aerobic fermentation and the like, and initiates the development of gas-liquid dispersion impellers. However, it was gradually found that the Rushton impeller had some defects: (1) the power under gassed condition is approximately 50% lower than the power under ungassed condition, this means high energy dissipation and low gas-liquid mass transfer efficiency; (2) the gas flooding phenomenon may easily occur at low gas flow rate, and the gas-liquid dispersion capability would be reduced. The above two defects are caused by the fact that low-pressure trailing vortexes easily occur at the back of the blades during the operating of the Rushton turbine, this may lead to separation of the fluid boundary layer. During the gas-liquid dispersion, the low-pressure core of the trailing vortex attracts bubble coalescence and gas cavities are formed at the back of the blades, and the gas cavities are the main reasons of energy dissipation with low efficiency.

On the basis of the classic Rushton impeller, many engineers made adjustments and optimizations on the shape, size, and detailed structure of the impeller blades, and developed the arrow-shaped blade impeller, the CD-6 impeller (Smith turbine), the concave impeller and the like, and improved the gas-liquid dispersion efficiency of the impellers. The blades of the above impellers are vertically symmetrical, and until 1998, Bakker invented an impeller assembly with asymmetrical concave blades, that is, BT-6 impeller, where the upper front edge of a blade tangentially extends and exceeds the lower front edge of the blade; in this way, the blade can capture more bubbles, and the more deep concave surface can significantly reduce the gas cavities formed at the back of the blade, thereby improving the gas-liquid dispersion efficiency and the gas flooding point.

The power draw of the radial flow impeller is related to the conditions such as the agitation speed, gas flow rate, and fluid physical properties, and is also related to the structure and mounting position of the impeller. Based on the cavitation phenomenon, the design of the radial flow impeller develops toward a more deep concave surface. Although the power consumption can be reduced by using deeper blades without increasing the width of the blades, the radial pump capacity is also largely reduced. The radial pump capacity is improved by increasing the width of the blades, but the diameter of the leading vertex on the outer edge is much larger than that of the trailing vertex, so that the blades produce large moment and power consumption in the vicinity of the leading vertex on the outer edge, but make small contributions to the radial pump capacity.

SUMMARY OF THE INVENTION

To solve the above problems, the present invention employs a special concave blade structure in an annular-sector-like shape, and the blade is designed such that the projection of the blade in the horizontal plane has an annular sector shape. In such a design, the increase in width of the conventional blade is changed into the increase of the arc length of the blade in the present invention, and the diameter of the leading vertex on the outer edge is equal to that of the trailing vertex, this avoids the excessive protrusions generated on the periphery of the blade, and effectively improves the dispersion and mixing performance of the impeller. The circumferential contour line of the blade used in the present invention is a spatial curve formed by bending a concave flat curve along a cylindrical surface centered with the agitating shaft, and this is beneficial to the efficient gas-liquid two-phase dispersion during the radial pumping process. The agitating device of the present invention has lower power consumption and better gas-liquid dispersion and mixing performance, greatly reduces the occurrence of the cavitation phenomenon and improves the gas flooding point, that is, higher gas flow rate is endurable under the same agitation speed, thereby enhancing the gas holdup performance.

The present invention provides an impeller device for gas-liquid dispersion and mixing in a reactor. The device includes an impeller, an agitating shaft and a power device. The impeller includes several radially extending concave blades, and the projections of the upper and lower portions of the concave blade in the horizontal plane are annular sector-shaped, and the radian of the annular sector obtained by the projection of the upper portion of the blade is larger than the radian of the annular sector obtained from the lower portion.

The inner edges and the outer edges of the blades respectively are on two cylindrical surfaces centered with the agitating shaft, and the radius difference between the two cylindrical surfaces is the length of the blades. A spatial curve is obtained by cutting the blade with a cylindrical surface of any radius, and these spatial curves are referred to as circumferential contour lines. The circumferential contour line may be regarded as being formed by bending a plane curve along the cylindrical surface and the plane curve is regarded as a basic shape line of the blade. Therefore, the circumferential contour line of the blade is on a cylindrical surface centered with the agitating shaft.

The basic shape line of the blade includes two leading vertexes and one trailing vertex. Divided by the disc plane, the part between the trailing vertex and the upper leading vertex is an upper-part shape line, the part between the trailing vertex and the lower leading vertex is a lower-part shape line, and the trailing vertex is in the disc plane. In this way, a basic shape line that is split vertically and has an acute angle is obtained. After the basic shape line is bent into a contour line, structural features such as all the leading vertexes and the trailing vertex in the contour line are corresponding to the vertexes in the basic shape line.

The projections of the upper and lower parts of the contour line in the horizontal plane are two segments of circular arcs. The arc length obtained by the projection of the upper part of the contour line is larger than that of the lower part, that is, the radian obtained by the projection of the upper part of the contour line is larger than the radian obtained from the lower part.

Taking the innermost radial contour line of a blade as a base line, the blade is obtained by radial extension of the base line by a length. In the radial extension process, the radians of the arcs obtained by the projections of the upper and lower parts of each contour line in the horizontal plane remain the same, and the arc length gradually increases. The axial height between the upper and lower leading vertexes of the contour line is referred to as an open height, which also remains the same in the radial extension process. The connection line between the upper leading vertexes of the contour lines forms an upper leading edge of the blade, the connection line between the lower leading vertexes forms a lower leading edge of the blade, and the connection line between the trailing vertexes forms a trailing edge of the blade. The upper leading edge, the lower leading edge and the trailing edge of the blade all pass through the central line of the agitating shaft, and their projection lines in the horizontal plane intersect at one point, that is, a central point of the disc.

Because the arc length of the upper part of the contour line is larger than the arc length of the lower part, after a blade is obtained by means of radial extension, the upper part of the blade has an annular sector shaped protrusion that the lower part does not have. The protrusion can help to capture rising bubbles, and enhance the gas holdup capability of the impeller.

In view of the above, the blade of the impeller has an annular-sector-like shape, and the projection of the blade in the horizontal plane is annular-sector-shaped. By using such blade, the conventional manner that a radial flow blade only parallelly extends in a radius direction where the trailing edge is located is changed into a manner that each part of the blade expands and extends in a radius direction thereof, so that a annular-sector-like shape is formed. By designing the blade into the above shape, the contour line of the blade is in a rotation direction of the impeller, and each part of the blade directly faces an incoming flow, so that the fluid is pumped radially and the utilization efficiency of the blade is greatly improved. The protrusion, which the lower part does not have, in the upper part of the blade helps to capture rising bubbles and enhance the gas holdup performance, so that the bubbles are easily pumped radially and dispersed in the liquid.

In an embodiment, the impeller further includes a disc and a hub. The concave blades are mounted on the disc. Each of the concave blades is divided into an upper portion and a lower portion by the disc plane.

In an embodiment, each blade has a certain thickness, and has the same shape as a leading surface.

In an embodiment, the inner edges and the outer edges of the blades are on two cylindrical surfaces centered with the agitating shaft, and the radius difference between the two cylindrical surfaces is the length of the blade.

In an embodiment, on a contour line in any radial position of the blade, the distance from a point on the lower portion to the disc plane is equal to the distance from a corresponding point on the upper portion to the disc plane. In this way, the consistency of the upper and lower extension of the blade is ensured, such that the flow field is relatively stable during agitating. However, there are no vertexes in the lower portion of the blade corresponding to the protrusion, which the lower portion does not have, in the upper portion of the blade, thus, some downward axial flows are produced, and this will enhance the circulation at the bottom of the impeller.

In an embodiment, the value of the radian $\beta$ of the annular sector obtained by the projection of the upper portion of the leading surface of the blade in the disc plane is generally in a range of 0.52 to 2.09.

In an embodiment, the ratio of the radians $\alpha$ and $\beta$ of the annular sectors respectively obtained by the projections of the lower portion and the upper portion of the leading surface of the blade in the disc plane is generally in a range of 0.45 to 0.85.

In an embodiment, the impeller further includes a hub for connecting the disc with the agitating shaft.

In an embodiment, the impeller further includes a horizontal disc, and a plurality of radially extending annular-sector-like concave blades mounted around the disc. The asymmetrical upper and lower portions of each blade are connected at the disc plane.

In an embodiment, the thickness of the disc does not exceed (is less than or equal to) the radius thereof, and the blades are uniformly distributed on the periphery of the disc.

In an embodiment, the ratio of the diameter of the disc to the diameter of the impeller is in a range of 0.5 to 0.8.

In an embodiment, the ratio of the axial height of the leading surface to the diameter of the impeller is in a range of 0.1 to 0.35.

In an embodiment, the ratio of the length of the leading surface to the diameter of the impeller is in a range of 0.15 to 0.4.

In an embodiment, the number of the blades of the impeller is 3 to 10.

In an embodiment, the projections of the extension lines of the projections of an upper leading edge, a lower leading edge and a trailing edge of the leading surface of the blade in the horizontal plane intersect at one point which is the central point of the disc.

In an embodiment, the radian of the circular arc obtained by the projection of the contour line of the blade in the horizontal plane remains the same during the radial extension.

In an embodiment, the contour line of the leading surface of the blade is a spatial curve, and the spatial curve can be formed by bending an elliptical arc, a circular arc, a parabolic curve, or any other plane curve in a similar shape along a cylindrical surface. The plane curve is generally in the shape of a parabolic curve.

In an embodiment, the agitating device is generally made of stainless steel, or alternatively made of other materials such as carbon steel and high-strength plastics.

In an embodiment, the hub and the disc are configured as a detachable split-type or a closed-type, which can be selected according to different working conditions.

In an embodiment, the hub is connected with the agitating shaft by a fastening screw, a tightening bolt or a flat key.

In an embodiment, the agitating device is generally used in a cylindrical reactor with an elliptical head or a dished head, and is mounted on a central axial thereof.

In an embodiment, the ratio of the diameter of the impeller to the inner diameter of the reactor is in a range of 0.25 to 0.6.

In an embodiment, the impeller is mounted at the bottom of the reactor, and may be used separately or used in combination with other impellers.

In an embodiment, a gas sparger is needed to be mounted below the impeller, and the ventilation direction of the gas sparger is upward or downward.

In an embodiment, the impeller rotates in a horizontal direction, such that the concave surface of each blade directly faces an incoming flow.

The agitating shaft in the device of the present invention is used for connecting the impeller with the power device, and drives the impeller to rotate to capture the rising bubbles and disperse the bubbles. The connection of the impeller with the agitating shaft is reinforced by the hub.

As compared with the prior art, the present invention has the following advantageous effects.

(1) The blade of the impeller in the present invention has a annular-sector-like spatial shape, and the projection of the blade in the horizontal plane is annular sector-shaped. By using such blade, the conventional manner that a radial flow blade only extends in a radius direction where the trailing edge is located is changed into a manner that each part of the blade extends in a radius direction thereof, so that a annular-sector-like shape is formed. By designing the blade into the above shape, any radial contour line of the blade is in a rotation direction of the impeller, and each part of the blade directly faces an incoming flow, so that the fluid is pumped radially and the utilization efficiency of the blade is greatly improved. The protrusion, which the lower portion does not have, in the upper portion of the blade helps to capture rising bubbles and enhance the gas holdup performance, so that the bubbles are easily pumped radially and dispersed in the liquid.

(2) The device of the present invention is characterized in high dispersion efficiency and low power consumption, the gas cavities at the back of the blade are smaller, gas dispersion is more sufficient, and the gas flooding point is higher during the aeration and agitation. The efficient and energy-saving gas-liquid dispersion impeller device of the present invention is applicable in reactors such as for aerobic fermentation, hydrogenation reaction, oxidation reaction and biological aeration, has low power consumption, high mixing performance, and high gas holdup and mass transfer performance, and can be used for dispersing gas into a liquid in an efficient and energy-saving manner.

DETAILED DESCRIPTION OF THE PREFERRED EMBODIMENTS

Figure 1:
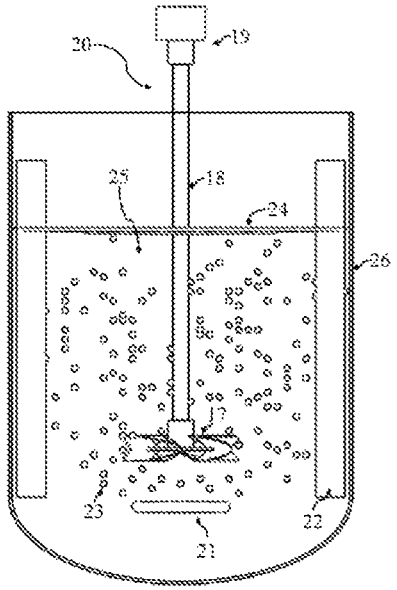
FIG. 1 is a front view of an agitating device in a reactor.
Figure 2:
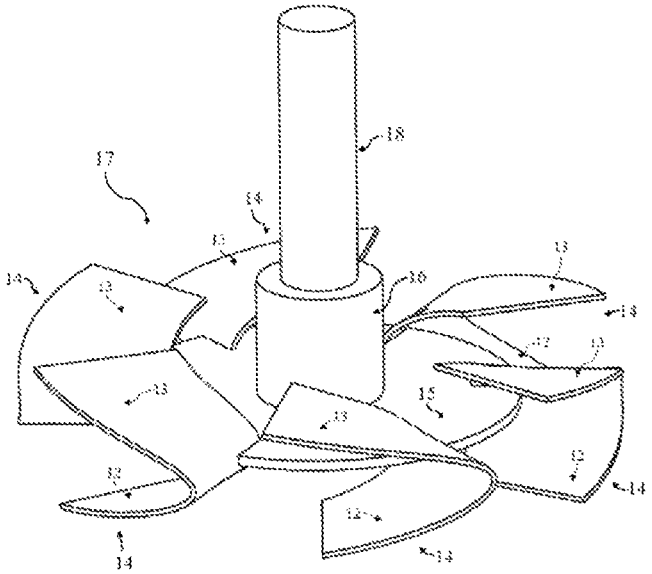
FIG. 2 is a schematic view of the impeller.

As shown in FIG. 1 and FIG. 2, the agitating device 20 provided in the invention comprises an impeller 17, an agitating shaft 18 and a set of power device 19. The impeller 17 includes a disc 15, a hub 16, and several radially extending blades 14.

Each of the blades 14 is obtained by the backward thickness increase of a leading surface 12, and a liquid opposite surface 13 is thus obtained. The technical features of the leading surface 12 represent the technical features of the blade 14.

Figure 3:
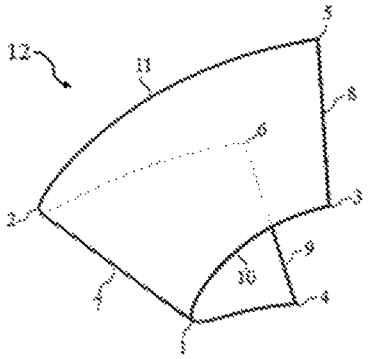
FIG. 3 is a schematic view of a leading surface of a blade in the impeller.

As shown in FIG. 3, the leading surface 12 is in the shape of a concave surface defined by an inner edge 10, an outer edge 11, an upper leading edge 8 and a lower leading edge 9, and is also in an annular sector-like shape formed by radial extension of the inner edge 10 to the outer edge 11. The inner edge 10 includes an upper leading vertex 3, a lower leading vertex 4 and a trailing vertex 1. The outer edge includes an upper leading vertex 5, a lower leading vertex 6 and a trailing vertex 2. The upper leading vertex 3 radially extends to the upper leading vertex 5 to form the upper leading edge 8, the lower leading vertex 4 radially extends to the lower leading vertex 6 to form the lower leading edge 9, and the trailing vertex 1 radially extends to the trailing vertex 2 to form a trailing edge 7.

The inner edge 10 is on a cylindrical surface passing through the radial position of the trailing vertex 1, and the outer edge 11 is on a cylindrical surface passing through the radial position of the trailing vertex 2. The intersection part of a cylindrical surface passing through any radial position on the trailing edge with the leading surface 12 is a spatial curve in the same shape as the inner edge 10 and the outer edge 11, and such spatial curves are collectively called contour lines of the leading surface 12. The contour line is a spatial curve obtained by bending, along the cylindrical surface, a plane curve that is perpendicular to the trailing edge at the position of the trailing vertex. The plane curve may be in the shape of an elliptical arc, a parabolic curve, a circular arc or other curves, and is preferably a parabolic curve.

Figure 4:
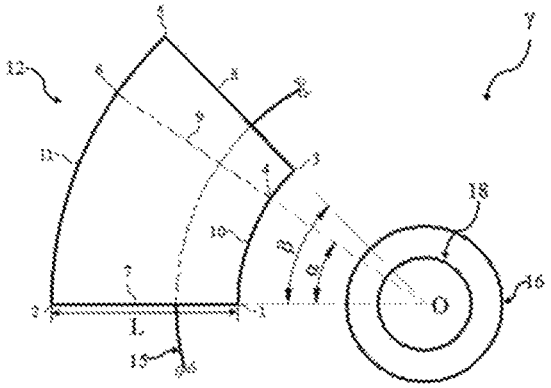
FIG. 4 is a top view of the leading surface of a single blade in the impeller.
Figure 6:
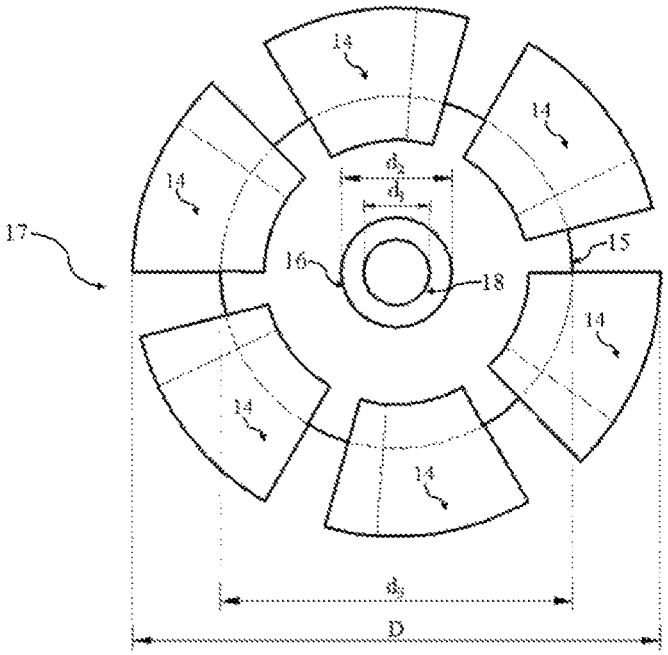
FIG. 6 is a top view of the impeller.

As shown in FIG. 4 and FIG. 6, the projection of the leading surface 12 in the horizontal plane $\gamma$ is annular-sector-shaped. The horizontal plane $\gamma$ is the horizontal plane where the disc 15 is located. The leading surface 12 may be divided into an upper portion and a lower portion by the horizontal plane $\gamma$. The projections of the upper and lower portions of the leading surface 12 form two annular sectors with different radians in the horizontal plane $\gamma$.

As shown in FIG. 4, the radian remains the same during the radial extension of the inner edge 10 to the outer edge 11. The extension lines of the projection lines of the upper leading edge 8 and the lower leading edge 9 of the leading surface 12 in the horizontal plane and the extension line of the trailing edge 7 intersect at one point O. The point O is a central point of the disc 15.

The radian (represented by $\beta$) of the annular sector obtained by the projection of the upper portion of the leading surface 12 in the horizontal plane $\gamma$ is larger than the radian (represented by $\alpha$) of the annular sector obtained by the projection of the lower portion in the horizontal plane $\gamma$, so that the upper portion of the leading surface 12 has a protrusion that the lower portion does not have, this helps to capture rising bubbles 23 and enhance gas-liquid dispersion.

The value of the radian β of the annular sector obtained by the projection of the upper portion of the leading surface 12 in the horizontal plane is generally in a range of 0.52 rad to 2.09 rad (the corresponding central angle is 30° to 120°), and is optimally 1.25 rad (the corresponding central angle is 72°). The ratio of the radian α of the annular sector obtained by the projection of the lower portion of the leading surface to the radian β obtained by the projection of the upper portion is generally in a range of 0.45 rad to 0.85 rad, and is optimally 0.75 rad (the corresponding central angle is 43°).

Figure 5:
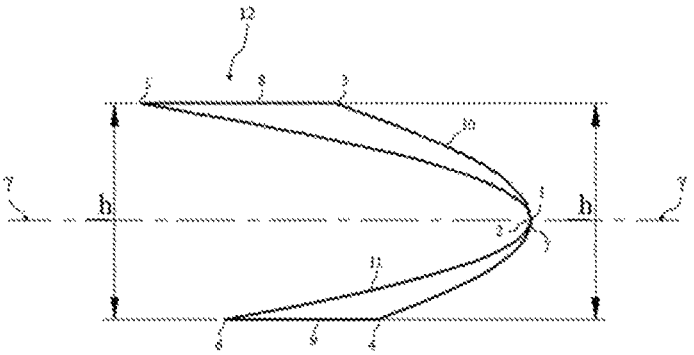
FIG. 5 is a front view of the leading surface of a single blade in the impeller.

As shown in FIG. 5, the height of the inner edge 10 of the leading surface 12 is equal to the height of the outer edge 11. The height of the inner edge 10 of the leading surface 12 refers to the axial height between the upper leading vertex 3 and the lower leading vertex 4 of the inner edge 10. The height of the outer edge 11 refers to the axial height between the upper leading vertex 5 and the lower leading vertex 6 of the outer edge 11. Similarly, the height of a contour line in any radial position of the leading surface 12 refers to the axial height between the upper leading vertex and the lower leading vertex of the contour line. The axial height of a contour line in any radial position of the leading surface 12 is the same, and the axial height is the height (represented by h) of the leading surface 12.

The shape and dimensional features of the leading surface 12 are as described above and represent the shape and dimensional features of the blade 14. The blade 14 is obtained by increasing the thickness of the leading surface 12 toward the external side of the concave surface.

As shown in FIG. 1, FIG. 2, and FIG. 6, the impeller 17 is provided with six blades 14 mounted on the disc 15. The number of the blades may be 3 to 10, and is preferably 6. The blades 14 are uniformly distributed on the periphery of the disc 15, and the trailing edges 7 are fixed to the disc 15, that is, the blades 14 are partially embedded into the disc 15 to ensure mechanical strength thereof. The ratio of the diameter (represented by $d_3$) of the disc 15 to the diameter (represented by D) of the impeller 17 is preferably in a range of 0.5 to 0.8, and is optimally 0.68.

The ratio of the axial height of the leading surface 12 to the diameter D of the impeller 17 is preferably in a range of 0.1 to 0.35, and is optimally 0.2.

As shown in FIG. 2 and FIG. 6, the ratio of the length (represented by L) of the leading surface 12 to the diameter D of the impeller 17 is preferably in a range of 0.15 to 0.4, and is optimally 0.3.

The disc 15 may be configured as other shapes, such as hollow-out strip-shaped. The thickness of the disc 15 is smaller than the radius thereof.

The impeller 17 is connected to the agitating shaft 18 by the hub 16, and the hub 16 is provided such that the impeller 17 is firmly connected to the agitating shaft 18.

As shown in FIG. 6, the hub 16 is within the range of the inner side of the blades 14, and the diameter (represented by $d_1$) of the agitating shaft 18 is smaller than the diameter (represented by $d_2$) of the hub 16. The diameters of the agitating shaft 18 and the hub 16 should be designed as small as possible while sufficient mechanical strength of the agitating shaft 18 and the hub 16 is maintained, such that the performance and the overall flow field of the impeller 17 is not influenced.

The hub 16 and the disc 15 are configured as a detachable split-type or a closed-type, selected according to different working conditions.

The power device 19 includes a motor and a speed reducer (not shown in detail), so that the impeller 17 obtains rotating power. The impeller 17 preferably rotates in the horizontal direction to keep balance.

As shown in FIG. 1, the impeller 17 is applied in a reactor 26 filled with a certain amount of a fluid 25, the fluid 25 may be a liquid, a mixture of several liquids, suspended particles or the like, and the shape of the reactor 26 may be cuboid, cylindrical or the like, and is preferably a cylindrical container having an elliptical head. Baffle plates 22 are generally additionally provided in the reactor 26 to prevent or reduce the generation of vortexes during rotation.

The ratio of the diameter D of the impeller 17 to the diameter (represented by T, not shown) of the reactor 26 is preferably in a range of 0.25 to 0.6, and is optimally 0.4.

The impeller 17 is preferably mounted near the bottom of the reactor 26, and may be used separately or used in combination with other radial flow or axial flow impellers to form an agitating system for use. The hub 16 and the agitating shaft 18 are connected by fastening screws, tightening bolts or flat keys, and the impeller 17 rotates with the agitating shaft 18. In use, the impeller 17 should be immersed in the fluid 25 in the reactor 26, that is, the liquid level 24 is higher than the impeller 17.

A gas sparger 21 is necessarily mounted below the impeller 17 for introducing bubbles 23 into the fluid 25.

As shown in FIG. 1, the gas sparger 21 is a ventilation ring. The gas sparger 21 may also be one or several ventilation pipes, metallic sintered mesh or of other types, and the ventilation direction of the gas sparger 24 may be upward or downward. The ventilation ring with upward ventilation direction is more common.

The agitating device 20 is made of stainless steel or other high-strength and corrosion-resistant materials such as carbon steel and high-strength plastics.

The specific operation of the agitating device 20 is as follows: the gas sparger 21 blows bubbles 23 into the fluid 25 in the reactor 26, the bubbles 23 rise due to its' lower density, the power device 19 provides power to enable the agitating shaft 18 and the impeller 17 to rotate in the horizontal direction at a certain rotation speed, the rotating blades 14 capture the rising bubbles 23 such that the rising bubbles 23 move radially along with the surrounding fluid 25, and the bubbles 23 are broken due to shearing action in the movement and thus are dispersed in the fluid 25. Two circulation flow patterns are formed above and below the impeller 17, and the purposes of gas-liquid dispersion and mixing are achieved by the release of the bubbles 23 in the gas sparger 21 and rotation of the impeller 17.

The above form of the device is a preferred example of the present invention, but the present invention is not limited thereby, and modifications are allowed to be made within a certain scope.

The above description is only preferred embodiments of the present invention and not intended to limit the present invention, it should be noted that those of ordinary skill in the art can further make various modifications and variations without departing from the technical principles of the present invention, and these modifications and variations also should be considered to be within the scope of protection of the present invention.

What is claimed is:

1. An agitating device, comprising an impeller, an agitating shaft and a power device, wherein the impeller comprises several radially extending concave blades, the projections of an upper portion and a lower portion of the concave blade in the horizontal plane being annular-sector-shaped, a circumferential contour line, an inner edge and an outer edge of the blades being on cylindrical surfaces centered with the agitating shaft, and the radian of the annular sector obtained by the projection of the upper portion of the blade being larger than the radian of the annular sector obtained by the projection of the lower portion.

2. The agitating device as claimed in claim 1, wherein the impeller further comprises a disc on which the concave blade being mounted and a hub, each concave blade being divided into the upper portion and the lower portion by the disc plane, and on a contour line in any radial position of the blade, the distance from a point on the lower portion to the disc plane being equal to the distance from a corresponding point on the upper portion to the disc plane.

3. The agitating device as claimed in 1, wherein the contour line is a spatial curve formed by bending a curve such as a parabolic curve, an elliptical arc, a hyperbolic curve or a circular arc along a cylindrical surface.

4. The agitating device as claimed in claim 1, wherein the value of the radian $\beta$ of the annular sector obtained by the projection of the upper portion of the leading surface of the blade in the disc plane is in a range of 0.52 rad to 2.09 rad.

5. The agitating device as claimed in claim 1, wherein the ratio of the radians $\alpha$ and $\beta$ of the annular sectors respectively obtained by the projections of the lower portion and the upper portion of the leading surface of the blade in the disc plane is generally in a range of 0.45 to 0.85.

6. The agitating device as claimed in claim 1, wherein the ratio of the length of the leading surface to the diameter of the impeller is in a range of 0.15 to 0.4.

7. The agitating device as claimed in claim 1, wherein the ratio of the diameter of the disc to the diameter of the impeller is in a range of 0.5 to 0.8.

8. The agitating device as claimed in claim 1, wherein the radian of a circular arc obtained by the projection of the contour line of the blade in the horizontal plane remains the same during the radial extension.

9. The agitating device as claimed in claim 1, wherein the extension lines of the projections of an upper leading edge, a lower leading edge and a trailing edge of the leading surface of the blade in the horizontal plane intersect at one point which is a central point of the disc.

10. The agitating device as claimed in claim 1, wherein each of the blades has a certain thickness, and has the same shape as the leading surface.

11. The agitating device as claimed in claim 1, wherein the inner edges and the outer edges of the blades are on two cylindrical surfaces centered with the agitating shaft, and the radius difference between the two cylindrical surfaces being the length of the blades.

12. The agitating device as claimed in claim 2, wherein the hub is connected to the disc and the agitating shaft.

13. The agitating device as claimed in claim 2, wherein the upper and lower portions of the blade are connected at the disc plane.

14. The agitating device as claimed in claim 2, wherein the thickness of the disc is less than or equal to the radius thereof, and the blades being uniformly distributed on the periphery of the disc.

15. The agitating device as claimed in claim 4, wherein the ratio of the axial height of the leading surface to the diameter of the impeller is in a range of 0.1 to 0.35.

16. The agitating device as claimed in claim 1, wherein the number of the blades of the impeller is 3 to 10.

17. The agitating device as claimed in claim 2, wherein the extension lines of the projections of an upper leading edge, a lower leading edge and a trailing edge of the leading surface of the blade in the horizontal plane intersect at one point which is a central point of the disc.

18. The agitating device as claimed in claim 2, wherein the radian of a circular arc obtained by the projection of the contour line of the blade in the horizontal plane remains the same during the radial extension.

19. The agitating device as claimed in claim 1, wherein the agitating device is generally made of stainless steel, or made of other materials such as carbon steel and high strength plastics.

20. The agitating device as claimed in claim 2, wherein the hub and the disc are configured as a detachable split-type or configured as a closed-type according to different operating conditions.

21. The agitating device as claimed in claim 12, wherein the hub is connected with the agitating shaft by a fastening screw, a tightening bolt, or a flat key.

22. The agitating device as claimed in claim 1, wherein the agitating device is generally used in a cylindrical reactor with an elliptical head or a dished head, and is mounted on a central axis thereof.

23. The agitating device as claimed in claim 22, wherein the ratio of the diameter of the impeller to the inner diameter of the reactor is in a range of 0.25 to 0.6.

24. The agitating device as claimed in claim 22, wherein the impeller is mounted at the bottom of the reactor, and can be used separately or used in combination with other types of impeller.

25. The agitating device as claimed in claim 22, wherein a gas sparger is mounted below the impeller, and the aeration direction of the gas sparger is upward or downward.

26. The agitating device as claimed in claim 1, wherein the agitating device rotates in a horizontal direction, such that the concave surface of the blade directly faces an incoming flow.

* * * * *